United States Patent [19]

Hackett

[11] 4,125,030

[45] Nov. 14, 1978

[54] SLANT AXIS ROTARY MECHANISM

[75] Inventor: David E. Hackett, Washington, Ill.

[73] Assignee: Caterpillar Tractor Co., Peoria, Ill.

[21] Appl. No.: 878,734

[22] Filed: Feb. 17, 1978

Related U.S. Application Data

[63] Continuation of Ser. No. 689,613, May 24, 1976, abandoned.

[51] Int. Cl.[2] ..... F16H 23/00

[52] U.S. Cl. ..... 74/60; 418/53

[58] Field of Search ..... 74/60; 418/53

[56] References Cited

U.S. PATENT DOCUMENTS

| | | | |
|---|---|---|---|
| 3,485,218 | 12/1969 | Clarke | 418/53 |
| 3,982,860 | 9/1976 | Staebler | 418/53 |
| 4,026,662 | 5/1977 | Goloff | 418/53 |

OTHER PUBLICATIONS

Clarke et al; A new class of rotary piston machine suitable for compressors, pumps and internal combustion engines; Prob Insin Mach. Engr. 1972, vol. 188 62/72.

*Primary Examiner*—Benjamin W. Wyche
*Assistant Examiner*—Wesley S. Ratliff, Jr.
*Attorney, Agent, or Firm*—Wegner, Stellman, McCord, Wiles & Wood

[57] ABSTRACT

An improved slant axis rotary mechanism including a housing defining a chamber having radially inner and outer spherical walls interconnected by opposed, generally radially extending side walls, a shaft journalled in the housing and having an angularly offset portion within the chamber, a timing gear within the chamber at one side thereof and surrounding the shaft, a rotor journalled on the angularly offset portion within the chamber and having a spherical hub and a peripheral, radially outwardly extending flange extending from the hub, and a ring gear carried by the hub on one end thereof and meshed with the timing gear. In the inventive mechanism, the included angle between opposite portions of the flange on the side opposite from the gears is less than 180° thereby enabling the thickness of the flange to be increased, or the wobble angle to be increased, or combinations of the foregoing.

2 Claims, 3 Drawing Figures

TYPICAL PRIOR ART

SLANT AXIS ROTARY MECHANISM

This is a continuation of application Ser. No. 689,613, filed May 24, 1976, now abandoned.

BACKGROUND OF THE INVENTION

This invention relates to slant axis rotary mechanisms, and, more particularly, to improved constructions for such mechanisms whereby their efficiency may be increased.

Slant axis rotary mechanisms such as those disclosed by Clarke in U.S. Pat. No. 3,485,218 issued Dec. 23, 1969, when used as internal combustion engines, are limited in output, due largely to the presence of high stresses in the mechanism main shaft. The limitation is generated by the fact that the diameter of the journal for the main shaft at the end thereof adjacent the timing gearing must be lesser than that at the opposite end since shaft diameter must be reduced, according to present design techniques, in order to accommodate the timing gearing required to produce the proper gear ratio.

A lesser, but yet significant factor in limiting output arises from the fact that the rotor flange must be designed to be as thin as possible in order to maximize displacement of the mechanism. However, the minimum thickness of the rotor flange is limited by bending stresses therein during operation which might cause interference between the parts during operation of the mechanism, the need to provide adequate cooling passages within the rotor including the flange, the need to provide craters or recesses in the flange to optimize combustion, etc.

SUMMARY OF THE INVENTION

It is the principal object of the invention to provide a new and improved slant axis rotary mechanism having an increased efficiency of operation. More specifically, it is an object of the invention to provide a new and improved slant axis rotary mechanism wherein the thickness of the flange may be increased, or the wobble angle may be increased, or combinations of the foregoing provided to increase mechanism efficiency. An increase in wobble angle causes an increase in displacement and permits an increase in the diameter of the main shaft adjacent to the timing gears.

An exemplary embodiment of the invention achieves the foregoing object in a slant axis rotary mechanism including a housing defining a chamber having radially inner and outer spherical walls interconnected by opposed, generally radially extending side walls. A shaft is journalled in the housing and has an angularly offset portion within the chamber. A timing gear is located within the chamber at one side thereof and surrounds the shaft. A rotor is journalled on the angularly offset portion of the shaft within the chamber and has a spherical hub and a peripheral, radially outwardly extending flange extending from the hub. A ring gear is carried by the hub at one end thereof and is meshed with the timing gear. The included angle between opposite portions of the flange on the side thereof opposite the gears is less than 180°.

As a consequence of the foregoing construction, the flange thickness may be increased without decreasing the wobble angle or the wobble angle may be increased to improve operating efficiency.

Other objects and advantages of the invention will become apparent from the following specification taken in connection with the accompanying drawings.

DESCRIPTION OF THE PREFERRED EMBODIMENTS

Figure 1:
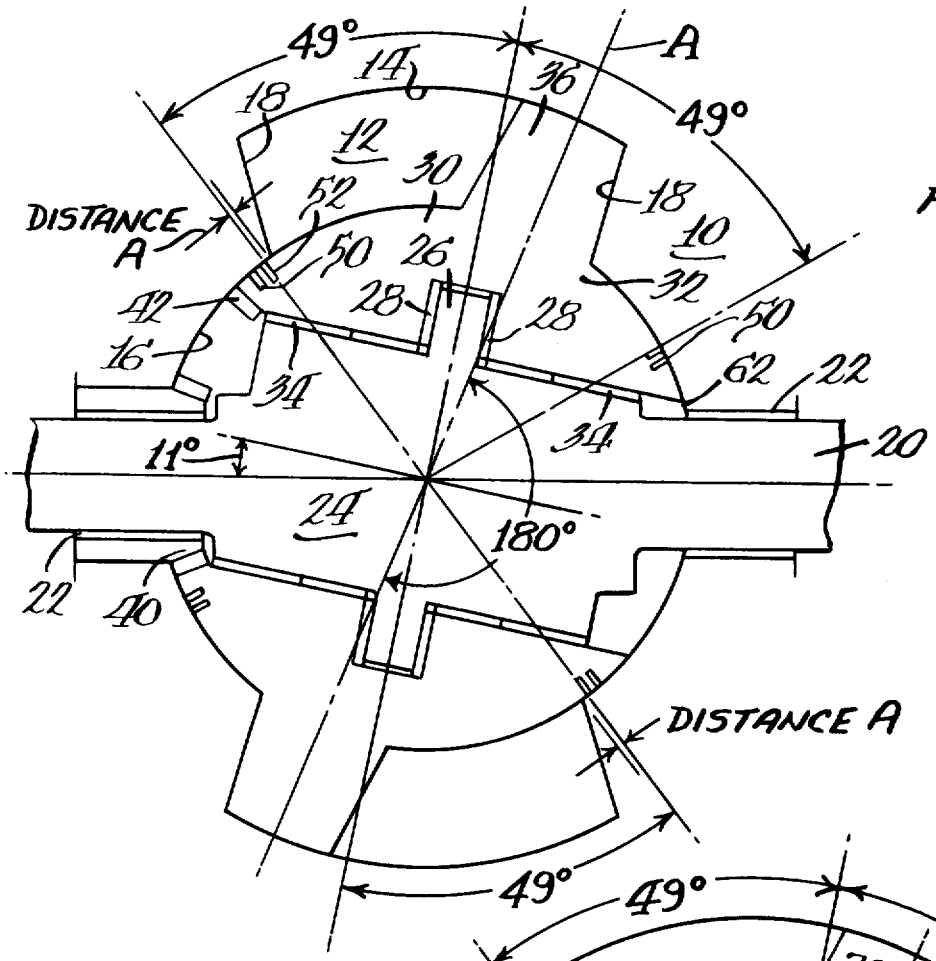
FIG. 1 is a somewhat schematic view of a typical slant axis rotary mechanism made according to the prior art.

A slant axis rotary mechanism made according to the prior art is illustrated in FIG. 1 in the form of a four-cycle mechanism. The same includes a housing 10, defining a chamber 12 having a radially outer spherical wall 14, a radially inner spherical wall 16 and opposed, generally radially extending side walls 18 interconnecting the spherical walls 14 and 16. A main shaft 20 is journalled in the housing by means of bearings 22 and has an angularly offset portion 24 within the chamber 12. A thrust collar 26 is disposed on the angularly offset portion 24 and embraces thrust bearings 28 received in the hub 30 of a rotor 32. The rotor 32 is journalled on the angularly offset portion 24 by means of journal bearings 34.

The hub 30 of the rotor 32 is spherical, as illustrated, and extending radially outwardly therefrom is a peripheral flange 36. As illustrated in FIG. 1, the included angle between a plane designated by a line A extending medially of opposite portions of the flange 38 is 180°.

A timing gear 40 is disposed within the chamber 12 adjacent one side thereof and is in mesh with the ring gear 42 carried by the hub 30 of the rotor 32 to establish proper relative rates of rotation. In a typical four-cycle mechanism, the gearing is such that there will be three revolutions of the shaft 20 for each single revolution of the rotor 32.

In the usual case, the angularly offset portion 24 will be offset from the axis of the shaft 20 by approximately 11°. This denominates the so-called "wobble angle" and is a factor in determining displacement of the mechanism. All other things remaining the same, the greater the wobble angle, the greater the displacement of the mechanism.

In this respect, it will be appreciated by those skilled in the art that the wobble angle is effectively set by the position of seals carried by the hub 30 of the rotor 32. At each end of the hub 30 there is an oil seal 50 and a compression seal 52 in sealing contact with the radially inner spherical wall 16. Such seals must never leave contact with the radially inner spherical wall and to ensure that such will not occur, typically, a distance designated "DISTANCE A" is maintained between the side of the compression seal 52 and the corner of the side wall 18 at its point of intersection with the radially inner spherical wall 16.

In prior art mechanisms, as illustrated in FIG. 1, the position of the seals 50 and 52 on opposite ends of the hub 30 has been made symmetrical, as, for example, spaced 49° to either side of a plane extending through the thrust collar 26. Since the position of the seals 50 and 52 on the end of the hub 30 adjacent the ring gear 42 is fixed by the size of the ring gear 42, which is necessary to maintain a correct timing ratio, and the distance A, the wobble angle, and thus displacement, is fixed by such constraints. At the same time, the thickness of the flange 36 is fixed due to considerations of deflection of the flange during operation of the mechanism, which deflections could cause interference between the parts if they become too large. The flange thickness is also determined by practical aspects, such as the need for coolant conduits and sizing and shaping of craters when the mechanism is employed as an internal combustion engine.

It is also to be observed that careful scrutiny of FIG. 1 will reveal that the diameter of the shaft 20 is greater on the end thereof remote from the timing gearing than at the end passing through the gear 40. In prior art constructions, the end of the shaft 20 adjacent the timing gear has been of reduced diameter so as to allow fabrication of the timing gear 40 to have sufficient strength to stand up over extended use and yet be of a size so as to have the number of teeth required to maintain the desired timing ratio.

The present invention is applicable to slant axis rotary mechanisms, particularly when used as engines but not limited thereto. For example, the invention will fine utility in slant axis rotary mechanisms employed as pumps, compressors, expanders, or the like. It is useful on such mechanisms whether operating on two-cycle or four-cycle principles and is based on the observation that one hub end of prior art rotor construction does not require the presence of the ring gear 42. Thus, as can be seen in FIG. 1, considerably more spacing exists between the oil seal 50 and the end of the hub remote from the timing gear 40 than between the oil seal 50 and the adjacent ring gear 42.

Figure 2:
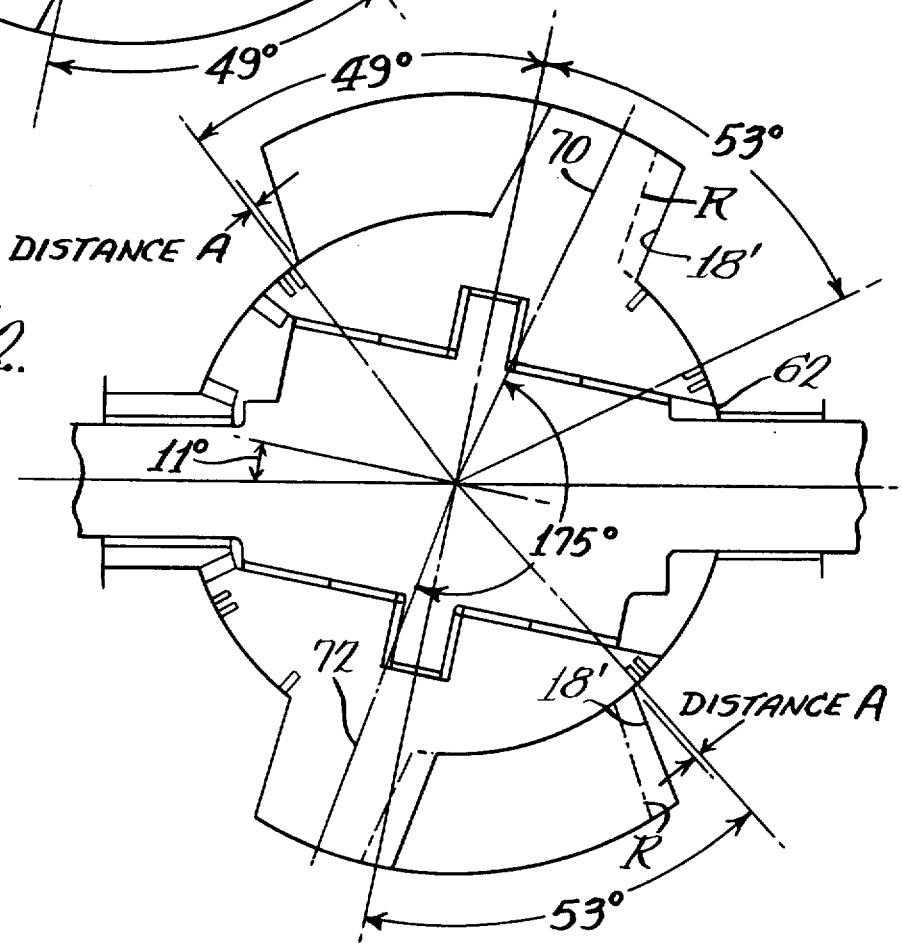
FIG. 2 is a view similar to FIG. 1 but of a slant axis rotary mechanism made according to the invention wherein rotor flange thickness is increased.

As seen in a slant axis rotary mechanism made according to the invention in FIG. 2, the seals on the end of the hub 30 remote from the gear 42, are shifted to a location closer to the corner 62. Whereas, in a prior art construction, as illustrated in FIG. 1, the angle between the plane extending through the thrust collar 26 and lines encompassing the closest position* of the compression seal 52 to the oil seal 50 is 49° on both sides of the rotor, the angle on the side remote from the timing gears in a slant axis rotary mechanism made according to the invention is increased to 53°. This permits a corresponding angular shift in the side wall 18 opposite from the timing gears to the position designated 18′ in FIG. 2. FIG. 2 also shows in dotted lines designated R where the side of the rotor flange 36 would be if the rotor were constructed according to the prior art. As is apparent, a considerable spacing exists between the side wall 18′ and the side R of a prior art rotor. As a consequence, the side of the rotor flange can be moved to substantial abutment with the side wall 18, thereby increasing the width of the rotor to minimize deflection, provide more room for improved coolant passages and/or permit the use of craters of greater depth to optimize combustion.

* Those skilled in the art will recognize that while the oil seals 50 have a circular configuration, the compression seals 52 do not. Rather, the compression seals have a scalloped configuration dimensioned such that for all positions of rotation of the rotor within the housing, the oil seal will engage the inner spherical wall closely adjacent the corner of the inner spherical wall and the associated side wall 18. Thus, the angle of 53°, as illustrated in FIG. 2, is between the plane passing through the thrust collar and the hypothetical position of the compression seal 52 if the same were circular and concentric with the oil seal 50.

As a consequence of expanding the rotor width, the included angle between lines 70 and 72 extending medially of opposite portions of the rotor is 175° on the side thereof remote from the timing gear. Stated another way, by constructing the mechanism to accommodate a rotor wherein the included angle between opposite portions of the flange on the side of the rotor remote from the timing gearing is less than 180°, rotor flange thickness may be increased.

Figure 3:
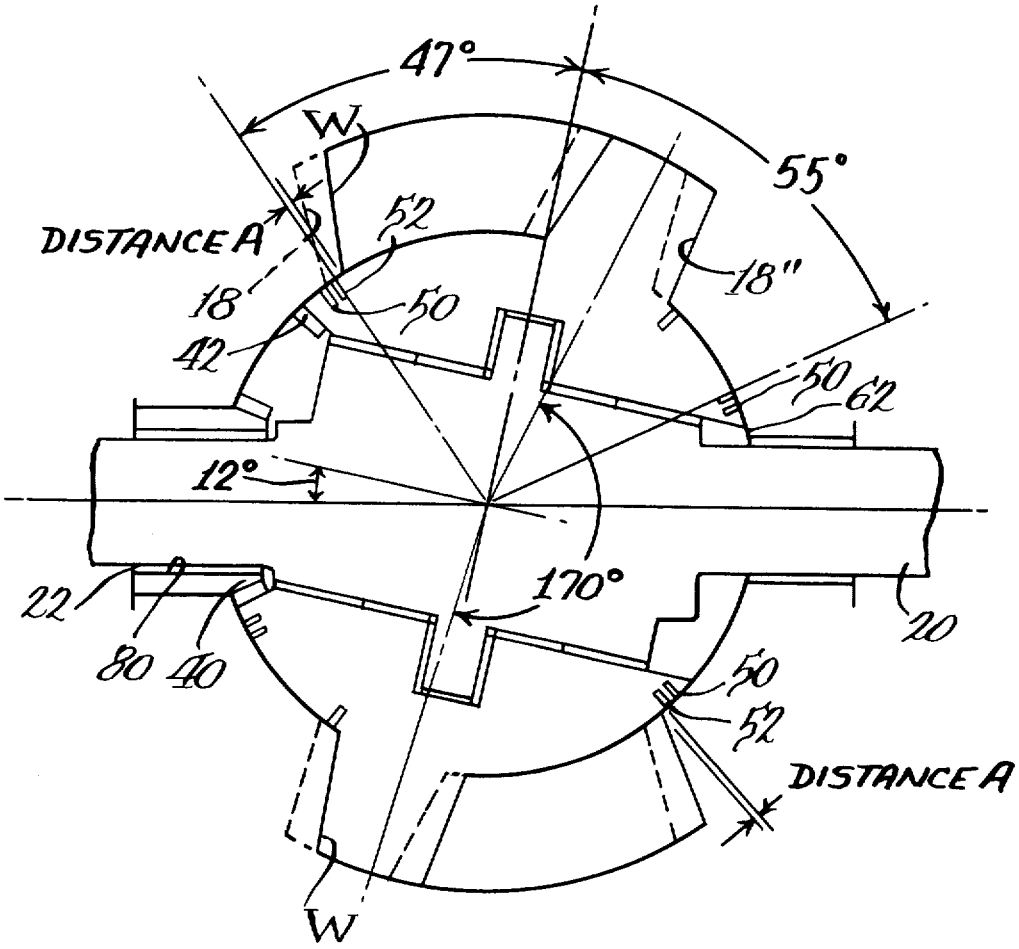
FIG. 3 is a view similar to FIGS. 1 and 2 but of a slant axis rotary mechanism made according to the invention wherein the wobble angle is increased.

FIG. 3 illustrates another embodiment of the invention wherein the wobble angle is increased. In particular, the seals 50 and 52 are shifted closer to the corner or end 62 of the hub 30 in the manner mentioned in connection with the description of FIG. 2 such that the angle between a plane extending through the thrust collar and a line extending through the hypothetical position of the compression seal is equal to 55°. A commensurate change is made in the position of the side wall 18″ remote from the timing gearing and the flange thickened on its side remote from the timing gearing appropriately.

However, the left-hand side of the flange, that is, the side adjacent the timing gearing, is trimmed so that the resulting flange has a thickness that is dictated by the considerations discussed in connection with the design of a typical prior art flange.

The removal of material on the left-hand side of the flange permits the end wall 18 adjacent the timing gearing to be moved from the position illustrated in dotted lines in FIG. 3 to the position designated W therein. This, in turn, permits the position of the seals 50 and 52 on the end of the hub 30 adjacent the timing gearing to be angularly shifted toward the flange while maintaining the distance A illustrated. As a consequence, there is a greater area on the end of the hub 30 adjacent the timing gearing for the ring gear 42. As a consequence, the ring gear 42 may be formed with a larger diameter than in prior art constructions, enabling the timing gear 40 to have a larger diameter and yet maintain the desired gear ratio while using a larger wobble angle. Because the timing gear 40 can be fabricated with a larger diameter, the bore 80 therein receiving the journal bearing 22 may be enlarged and the bore of the journal bearing 22 receiving the end of the shaft 20 at the timing gearing may be enlarged and still provide efficient structural rigidity. Thus, the end of the shaft 20 adjacent the timing gearing can be increased and, as illustrated in FIG. 3, is of the same diameter as the end of the shaft opposite from the gearing.

The particular changes require an increase in the wobble angle from 11° to 12° so that the total displacement of the mechanism is increased. It will also be noted that such a construction is facilitated by fabricating the rotor such that the included angle between a line extending medially through the rotor flange at opposite ends thereof is less than 180° on the side thereof opposite from the timing gearing. In the embodiment illustrated, such an included angle is equal to 170°.

It should be recognized that, with the exception of the prior art construction illustrated in FIG. 1, the angles illustrated are merely illustrative of forms of the invention and are not intended to be limiting. Those skilled in the art will recognize that the essential of the invention allowing the increase in the thickness of the rotor flange to achieve the advantages mentioned previously, or allowing the increasing of the wobble angle is the asymmetrical configuration of the rotor flange wherein the included angle between lines extending medially of opposite portions of the flange on the side of the rotor remote from the timing gearing is less than 180°.

It will also be recognized that the essential angular relation may be employed to achieve the increase in flange thickness or the increase in wobble angle, either singly or in combination with each other. When shaft diameter is to be increased, the wobble angle must of necessity be increased to accommodate the larger gearing required, thereby providing an increase in displacement as well.

I claim:

1. In a slant axis rotary mechanism, the combination of:

a housing defining a chamber having radially inner and outer spherical walls interconnected by opposed, generally radially extending side walls;

a shaft journalled in said housing and having an angularly offset portion within said chamber;

a timing gear within said chamber at one side thereof and surrounding said shaft;

a rotor journalled on said angularly offset portion within said chamber having a spherical hub and a peripheral, radially outwardly extending flange extending from said hub; and a ring gear carried by said hub on one end thereof and meshed with said timing gear;

the included angle between opposite portions of said flange on the side opposite said gears being less than 180° whereby the thickness of said flange may be increased.

2. In a slant axis rotary mechanism, the combination of:

a housing defining a chamber having radially inner and outer spherical walls interconnected by opposed, generally raidally extending side walls;

a shaft journalled in said housing and having an angularly offset portion within said chamber;

a timing gear within said chamber at one side thereof and surrounding said shaft;

a rotor journalled on said angularly offset portion within said chamber having a spherical hub and a peripheral, radially outwardly extending flange extending from said hub; and a ring gear carried by said hub on one end thereof and meshed with said timing gear;

the included angle between opposite portions of said flange on the side opposite said gears being less than 180° whereby the angularity of the offset portion of the shaft may be increased.

* * * * *